US008632354B2

(12) United States Patent
George et al.

(10) Patent No.: US 8,632,354 B2
(45) Date of Patent: Jan. 21, 2014

(54) INTERCONNECTION SYSTEMS

(75) Inventors: Michael George, Pleasanton, CA (US); Jonathan J. Hubert, Los Gatos, CA (US); John S. Geldman, Los Gatos, CA (US)

(73) Assignee: Micron Technology, Inc., Boise, ID (US)

( * ) Notice: Subject to any disclaimer, the term of this patent is extended or adjusted under 35 U.S.C. 154(b) by 2 days.

(21) Appl. No.: 13/211,103

(22) Filed: Aug. 16, 2011

(65) Prior Publication Data

US 2013/0045621 A1 Feb. 21, 2013

(51) Int. Cl.
*H01R 13/64* (2006.01)

(52) U.S. Cl.
USPC ..... 439/375

(58) Field of Classification Search
USPC ..... 439/378, 379, 677, 680, 374
See application file for complete search history.

(56) References Cited

U.S. PATENT DOCUMENTS

| | | | | | |
|---|---|---|---|---|---|
| 5,125,849 | A * | 6/1992 | Briggs et al. | 439/378 |
| 5,125,854 | A | 6/1992 | Bassler et al. | |
| 5,609,493 | A * | 3/1997 | Cheng et al. | 439/157 |
| 5,620,329 | A * | 4/1997 | Kidd et al. | 439/248 |
| 5,791,377 | A * | 8/1998 | LaRochelle | 138/33 |
| 5,898,569 | A * | 4/1999 | Bhatia | 361/700 |
| 5,984,731 | A * | 11/1999 | Laity | 439/676 |
| 6,111,751 | A * | 8/2000 | Sakuyama | 361/704 |
| 6,116,962 | A * | 9/2000 | Laity | 439/676 |
| 6,162,089 | A * | 12/2000 | Costello et al. | 439/541.5 |
| 6,183,308 | B1 * | 2/2001 | Laity | 439/676 |
| 6,224,420 | B1 * | 5/2001 | Nishio et al. | 439/566 |
| 6,331,122 | B1 * | 12/2001 | Wu | 439/567 |
| 6,371,790 | B1 * | 4/2002 | Huang | 439/378 |
| 6,488,542 | B2 * | 12/2002 | Laity | 439/676 |
| 6,565,390 | B2 * | 5/2003 | Wu | 439/680 |
| 6,616,342 | B2 * | 9/2003 | Kiani | 385/54 |
| 6,646,887 | B2 * | 11/2003 | Yang et al. | 361/759 |
| 6,729,897 | B2 * | 5/2004 | Lai | 439/347 |
| 6,764,222 | B1 * | 7/2004 | Szilagyi et al. | 385/55 |
| 6,824,419 | B1 * | 11/2004 | Wu | 439/378 |
| 6,830,469 | B1 * | 12/2004 | Doyle et al. | 439/247 |
| 6,899,564 | B2 * | 5/2005 | Lee | 439/606 |
| 6,902,432 | B2 * | 6/2005 | Morikawa et al. | 439/607.41 |
| 6,964,586 | B2 * | 11/2005 | Siddiqui | 439/669 |
| 6,976,111 | B1 * | 12/2005 | Mills et al. | 710/301 |
| 7,128,608 | B1 * | 10/2006 | Chen | 439/607.53 |
| 7,128,609 | B1 * | 10/2006 | Chen | 439/607.53 |
| 7,198,503 | B1 * | 4/2007 | Chen et al. | 439/378 |
| 7,275,963 | B2 * | 10/2007 | Kurita | 439/630 |
| 7,278,877 | B2 * | 10/2007 | Cho | 439/502 |
| 7,285,004 | B1 * | 10/2007 | Fukuda et al. | 439/358 |
| 7,428,834 | B1 * | 9/2008 | Lee | 70/57 |
| 7,467,977 | B1 * | 12/2008 | Yi et al. | 439/607.01 |
| 7,520,781 | B2 * | 4/2009 | Clayton et al. | 439/631 |
| 7,623,182 | B2 * | 11/2009 | Byrne et al. | 348/375 |
| 7,670,156 | B2 * | 3/2010 | Chen | 439/108 |
| 7,708,602 | B2 | 5/2010 | Rascon et al. | |
| 7,798,726 | B2 | 9/2010 | Sabo | |
| 7,815,450 | B1 * | 10/2010 | Chen et al. | 439/218 |

(Continued)

*Primary Examiner* — Amy Cohen Johnson
*Assistant Examiner* — Vladimir Imas
(74) *Attorney, Agent, or Firm* — Schwegman, Lundberg & Woessner

(57) ABSTRACT

Interconnection systems are shown that include communication contacts, and a guide. Configurations are shown with a guide that locates a male portion with respect to a female portion and guides their engagement before any communication contacts are engaged. Configurations are also shown with a guide that includes one or more power contacts.

29 Claims, 3 Drawing Sheets

(56) References Cited

U.S. PATENT DOCUMENTS 8,070,533 B1 * 12/2011 Tai et al. ..... 439/681
8,152,558 B2 * 4/2012 Broeksteeg et al. ..... 439/378
8,251,754 B2 * 8/2012 Tai et al. ..... 439/681
2010/0158449 A1 6/2010 Yi

* cited by examiner

INTERCONNECTION SYSTEMS

TECHNICAL FIELD

Various embodiments described herein relate to apparatus, systems, and methods associated with interconnection systems.

BACKGROUND

As electronic devices are getting smaller, interconnection systems (e.g., cables, connections, interfaces, mechanisms, and/or structures and the like) are also getting smaller. As size is reduced, concerns such as mechanical integrity and reliability become more prominent. One example includes peripheral devices for computers. Universal Serial Bus (USB) interconnection systems have evolved from USB type A, to mini USB, to micro USB. Other electronic devices also use interconnection systems for items such as removable memory cards. Such cards are typically used so that the edges of the card act as alignment surfaces, which may result in a slight misalignment with regards to the electrical connections of the card and receptacle. For example, electronic devices such as digital cameras, tablet computers, mobile telephones, etc. can interface with memory cards. What is needed is an improved interconnection system with properties such as good mechanical integrity and reliability.

DETAILED DESCRIPTION

In the following detailed description of the invention, reference is made to the accompanying drawings that form a part hereof and in which are shown, by way of illustration, specific embodiments in which the invention may be practiced. These embodiments are described in sufficient detail to enable those skilled in the art to practice the invention. Other embodiments may be utilized and logical, electrical, material changes, etc. may be made.

Figure 1:
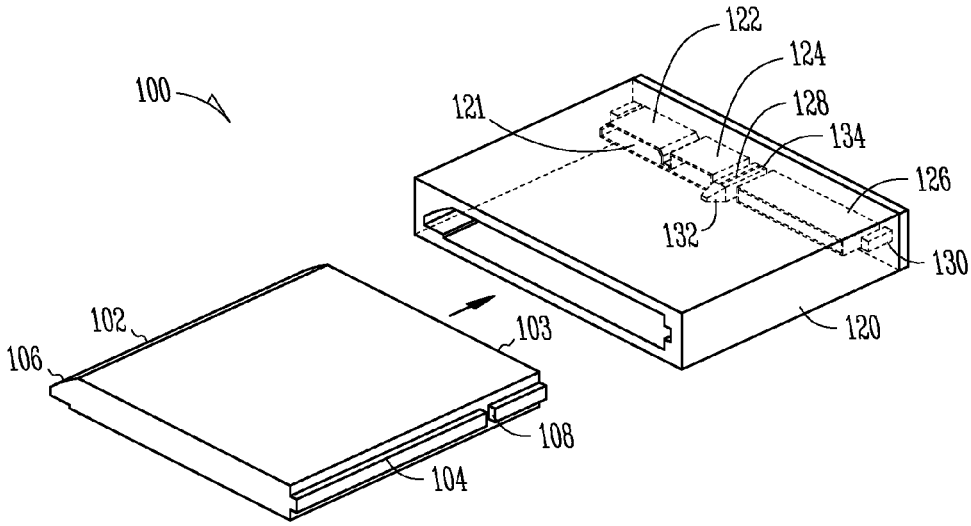
FIG. 1 shows an isometric view of an interconnection system according to an embodiment of the invention.

FIG. 1 shows an interconnection system 100 according to an embodiment of the invention. An male portion 102 is shown with a corresponding female portion 120. In the example shown, the male portion 102 can be integrated with a peripheral electronic device, and the female portion 120 can be arranged as a socket of a host device (not shown). In other examples, the peripheral device may include the female portion, and the host device may include the male portion.

The male portion 102 in FIG. 1 can be structured as part of a card. In one example, the card includes non-volatile memory such as flash memory. The memory device may include a number of possible configurations (e.g. NAND, NOR, etc.). The card may contain some input/output functionality, such as IEEE 802.11 wireless capability, or even combinations of functionality. Although the male portion 102 shown in FIG. 1 includes a memory device, the invention is not so limited. In other embodiments, the male portion 102 includes an end of a cord (not shown) coupled between, for example, a host device, and a peripheral device.

FIG. 1 shows the male portion 102 including a unique geometry that mates with the female portion 120. For example, a slanted side 106 and a rail 104 are shown on the male portion 102. Configurations with unique features (e.g. slants, rails) prevent users from inadvertently trying to couple the male portion 102 with the female portion 120 in the wrong way. By providing only one way to insert the male portion 102 into the female portion 120, unwanted events such as short circuits, mechanical damage, etc. are prevented.

FIG. 1 also illustrates a latch 108. In selected embodiments, for example a memory card embodiment, the male portion 102 is inserted into the female portion 120, and latched to prevent the memory card or other device from falling out of the female portion 120. FIG. 1 further illustrates a bias post 130, such as a spring loaded post. In selected examples, the male portion 102 is pushed into the female portion 120 once to engage the latch 108. If removal of the male portion 102 is desired, a second push deactivates the latch 108, and the bias post 130 at least partially ejects the male portion 102 from within the female portion 120.

A number of first communication contacts (e.g., connectors, conductors, pins, posts, terminals, waveguides, etc.) 121 are shown in the female portion 120, to interface with a number of second communication contacts (not shown) on the male portion 102. In one example, the communication contacts 121 include electronic communication contacts, such as metal conductors. In one example, the communication contacts 121 include optical communication contacts, such as fiber optic interfaces.

In one example, the communication contacts 121 are grouped into one or more arranged protocols, such as USB, SATA, etc. FIG. 1 illustrates a USB 2.0 protocol arrangement 122 and a USB 3.0 protocol arrangement 124. Other examples of protocols include mini USB 2.0, and micro USB 2.0. An unoccupied region 126 is included in one example for future inclusion of additional protocol arrangements. Although two separate protocol arrangements 122, 124 are shown in FIG. 1, other examples include only one arrangement, or more than two.

In addition to communication contacts 121, in one example, a port 140 may be included for transmission of media, such as gas or liquid media. For example, liquid can be transmitted for cooling of one or more components. Hydrogen gas can be transmitted for power, such as in a hydrogen fuel cell. A port 140 is shown in the front view of the male portion 120 of FIG. 2. In one embodiment, the port 140 is located within a region 116 for expansion of additional future protocol arrangements. In one embodiment, the port 140 is integrated within a guide 128, as described below.

A guide (e.g., a pin, post, etc.) 128 is further illustrated in FIG. 1. The guide 128 includes a leading taper section 132 and a tolerance fit section 134. In the present disclosure, a tolerance fit describes an interface between two components (e.g. guide 128 and guide hole 118) where the tightness of the fit is controlled to limit an available amount of play between the components. Inclusion of a tolerance fit in a mechanically robust component such as a guide, and the resulting limited amount of play available, can protect more sensitive components such as communication contacts from damage due to excessive play during insertion of the male portion 102 into the female portion 120.

In one example, the guide 128 is configured with a length, such that when the male portion 102 is inserted into the female portion 120, the leading taper section is the first item within the female portion 120 to make contact on the front surface 103 of the male portion 102. Next, the tolerance fit section 134 of the guide 128 engages (e.g., mates with) a guide hole (118 in FIG. 2) in the male portion.

In one example, any tolerance issue between the male portion's rail and slanted side (104 and 106 in FIG. 1), and the female portion's (120 in FIG. 1) matching mating surfaces, and the male portion's (102 in FIG. 1) communication contacts and the female portion's communication contacts (121 in FIG. 1), may be resolved by having section 134 of the guide 128 engage the guide hole before any communication contacts 121 interface with each other between the male portion 102 and the female portion 120. When the tolerance fit section 134 engages the guide hole 118 first, alignment of the male portion 102 and the female portion 120 is ensured prior to any engagement between corresponding communication contacts. This protects the communication contacts 121 from mechanical damage.

Figure 2:
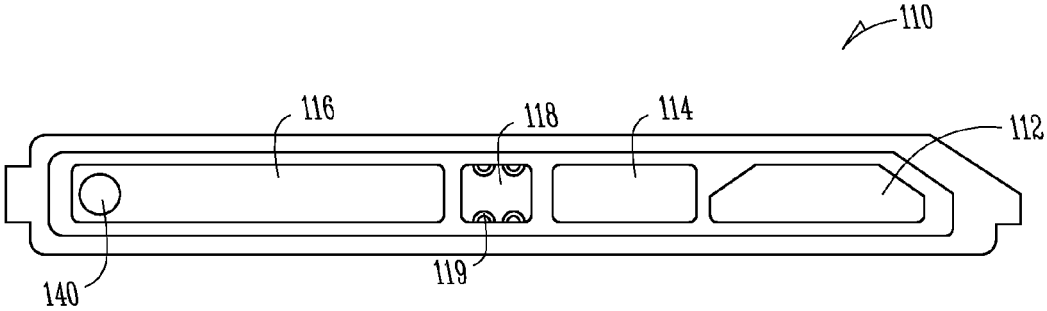
FIG. 2 shows a front view of a memory device from FIG. 1 according to an embodiment of the invention.

In one example, the guide 128 further includes one or more power contact surfaces. FIG. 2 shows the guide hole 118 with a number of contact surfaces 119 that correspond to power contact surfaces on the guide 128. Although four contact surfaces 119 are show in the guide hole 118 of FIG. 2, other configurations may include one, two, three or more contact surfaces. Example configurations of power contact surfaces on guides 128 are discussed in more detail below, regarding FIGS. 3A-3C. FIG. 2 further shows a first mating connection 112 and a second mating connection 14 for coupling with protocol arrangements 122 and 124 respectively.

In one example, power contact surfaces on the guide 128 engage corresponding power contact surfaces 119 within the guide hole 118 before any communication contacts 121 interface with each other between the male portion 102 and the female portion 120. In one example, the power contact surfaces on the guide 128 are located within the tolerance fit section 134 of the guide 128 to facilitate the timing of engagement. When the power contact surfaces on the guide 128 engage power contact surfaces 119 within the guide hole 118 first, an electrical connection between the male portion 102 and the female portion 120 is ensured prior to any engagement between corresponding communication contacts. In one example, engagement between the power contact surfaces on the guide 128 and the power contact surfaces 119 within the guide hole 118 is monitored by a circuit, and no transmission (e.g. data transmission) is performed before the power connection is checked. This protects the communication contacts 121 and devices such as memory cells coupled to the communication contacts from electrical damage.

In one example the guide provides the additional functionality of a heat exchange capability between the female portion 120 and the male portion 102, such as a heat pipe. In one example the guide provides the additional functionality of a conduit for exchange of other gaseous or liquid materials to support male portion 102 functionality.

Although a single guide 128 is shown, other embodiments may include multiple guides 128. In one example different guides 128 include one or more different functionalities described above, such as heat exchange, power supply, material transport, etc.

Figure 3A:
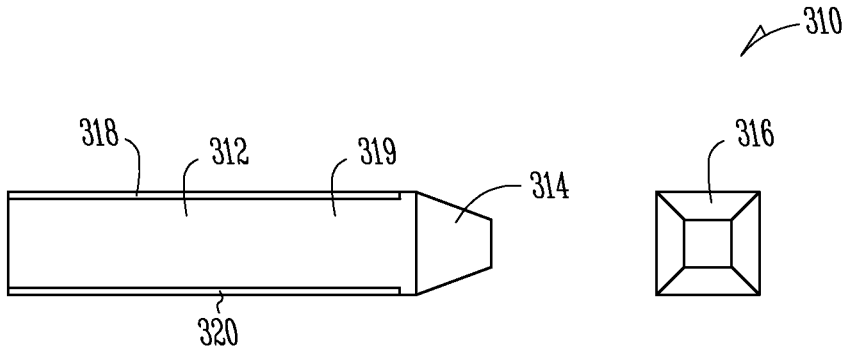
FIG. 3A shows a guide according to an embodiment of the invention.

FIG. 3A shows one example of a guide 310 that may be used similar to guide 128 from FIG. 1. The guide 310 includes a tolerance fit section 312 and a non-conductive leading taper section 314. The leading taper section 314 is shown in a front end view 316. The guide 310 includes two power contact surfaces 318 and 320, with an insulating material 319 separating the contact surfaces 318 and 320. In the example shown, the power contact surfaces 318 and 320 are on opposite sides of the guide 310. Other configurations may include the power contact surfaces 318 and 320 on adjacent sides of the guide 310.

In one example, the power contact surface 318 includes a supply contact surface. Examples of supply voltages may include 3.3V, 1.8V, or other voltages suitable for powering a peripheral device. In one example, power contact surface 320 include a ground contact surface. In other examples, the power contact surface 320 may include a voltage that is different than the power contact surface 318.

Figure 3B:
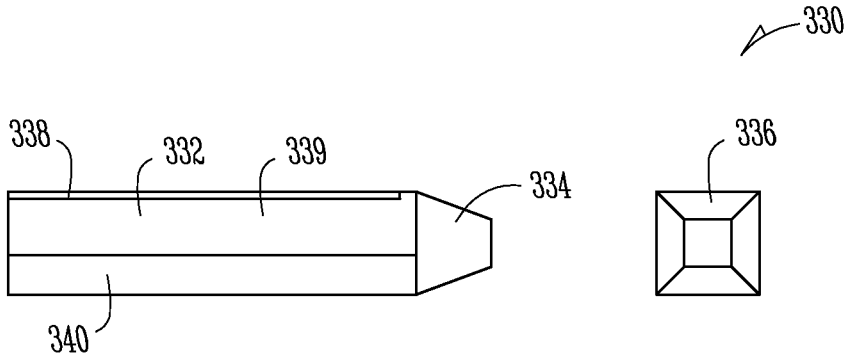
FIG. 3B shows a guide according to an embodiment of the invention.

FIG. 3B shows another example of a guide 330 that may be used similar to guide 128 from FIG. 1. The guide 330 includes a tolerance fit section 332 and a leading taper section 334. The leading taper section 334 is shown in a front end view 336. Similar to guide 310, the guide 330 includes two power contact surfaces 338 and 340, with an insulating material 339 separating the contact surfaces 338 and 340. In the example shown, the power contact surfaces 338 and 340 are on opposite sides of the guide 330.

In FIG. 3B, the power contact surface 338 includes a supply contact surface. Examples of supply voltages may include 3.3V, 1.8V, or other voltages suitable for powering a peripheral device. In one example power contact surface 340 include a ground contact surface. In FIG. 3B, the ground power contact surface 340 is integrated with, or otherwise coupled to, the leading taper section 334. This configuration facilitates the ground power contact surface 340 engaging before the supply contact surface 338. This configuration can further prevent electrical damage by ensuring a ground before any power is supplied.

Figure 3C:
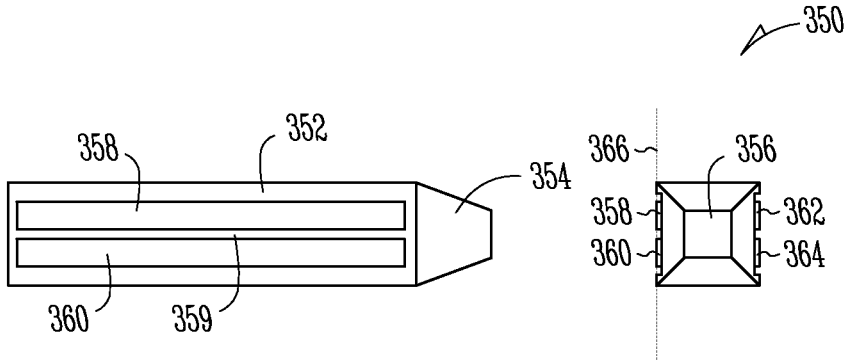
FIG. 3C shows a guide according to an embodiment of the invention.

FIG. 3C shows another example of a guide 350 that may be used similar to guide 128 from FIG. 1. The guide 350 includes a tolerance fit section 352 and a non-conductive leading taper section 354. The leading taper section 354 is shown in a front end view 356. The guide 350 includes more than two contact surfaces separated by insulating material 359. FIG. 3C shows a first contact surface 358, a second contact surface 360, a third contact surface 362, and a fourth contact surface 364.

In the example shown, the first contact surface 358, and the second contact surface 360 are both supply contact surfaces, with different voltages. In one example, the first contact surface 358 is a 3.3V supply, and the second contact surface 360 is a 1.8V supply. In one example, the third contact surface 362 is a ground. In one example the fourth contact surface 364 provides one or more communication contacts such as supporting a system peripheral interface (SPI) or $I_2C$ interface.

FIG. 3C, in the end view 356, illustrates the contact surfaces 358, 360, 362, 364, located in a recess below a surface 366 of the tolerance fit section 352. This configuration provides good mechanical alignment of the male portion 102 and female portion 120, without relying on the contact surfaces 358, 360, 362, 364 as the alignment surfaces. The surface 366 of the tolerance fit section 352 can be made of a material that provides better friction and wear characteristics, while the contact surfaces 358, 360, 362, 364 can be made of materials that provide better power transmission.

Figure 4:
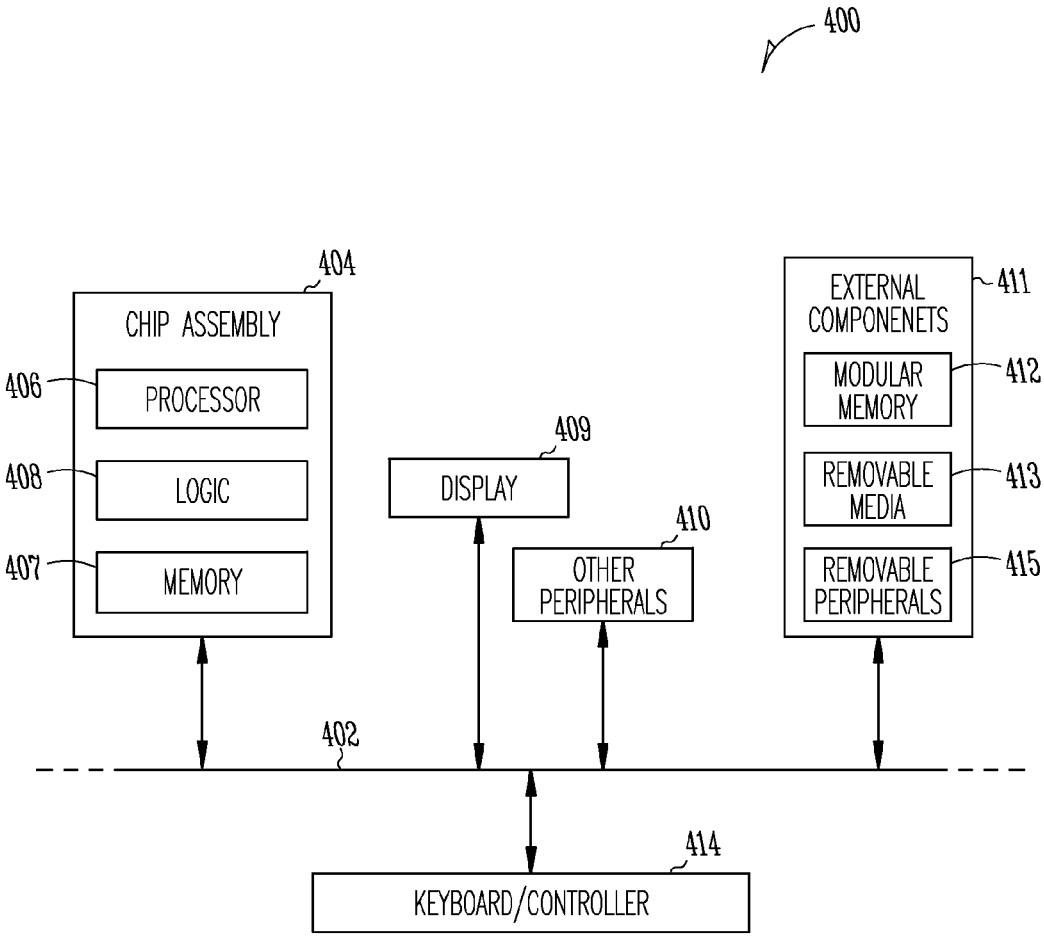
FIG. 4 shows an information handling system according to an embodiment of the invention.

An embodiment of an information handling system such as a computer is included in FIG. 4 to show an embodiment of a high-level device application. FIG. 4 is a block diagram of an information handling system 400 incorporating a interconnection system according to an embodiment of the invention. The information handling system 400 shown in FIG. 4 is merely one example of a system in which the present invention can be used. Other examples include, but are not limited to, tablet computers, notebook PSs, cellular telephones, media players, aircraft, satellites, military vehicles, etc.

In this example, information handling system 400 comprises a data processing system that includes a system bus 402 to couple the various components of the system. System bus 402 provides communications links among the various components of the information handling system 400 and may be implemented as a single bus, as a combination of busses, or in any other suitable manner.

Chip assembly 404 is coupled to the system bus 402. Chip assembly 404 may include any circuit or operably compatible combination of circuits. In one embodiment, chip assembly 404 includes a processor 406 that can be of any type. As used herein, "processor" means any type of computational circuit such as, but not limited to, a microprocessor, a microcontroller, a graphics processor, a digital signal processor (DSP), or any other type of processor or processing circuit or cores thereof. Multiple processors such as "multi-core" devices are also within the scope of the invention.

In one embodiment, a memory device 407, is included in the chip assembly 404. Those skilled in the art will recognize that a wide variety of memory device configurations may be used in the chip assembly 404. Acceptable types of memory chips include, but are not limited to, Dynamic Random Access Memory (DRAMs) such as SDRAMs, SLDRAMs, RDRAMs and other DRAMs. Memory chip 407 can also include non-volatile memory such as NAND memory or NOR memory.

In one embodiment, additional logic chips 408 other than processor chips are included in the chip assembly 404. An example of a logic chip 408 other than a processor includes an analog to digital converter. Other circuits on logic chips 408 such as custom circuits, an application-specific integrated circuit (ASIC), etc. are also included in one embodiment of the invention.

Information handling system 400 may also include external components 411, which can include one or more functional elements, such as one or more modular memory components 412, such as hard drives, one or more devices that handle removable media 413 such as memory cards, compact disks (CDs), digital video disks (DVDs), and the like, and/or removable or modular input/output functionality for removable peripherals 415, such as IEEE 802.11, GSM, CDMA, Bluetooth and the like. In one example, one or more external components 411 and a removable interface include an interconnection system according to embodiments of the invention.

Information handling system 400 may also include a display device 409 such as a monitor, additional peripheral components 410, such as speakers, etc. and a keyboard and/or controller 414, which can include a mouse, or any other device that permits a system user to input data into and receive data from the information handling system 400.

While a number of embodiments of the invention are described, the above lists are not intended to be exhaustive. Although specific embodiments have been illustrated and described herein, it will be appreciated by those of ordinary skill in the art that any arrangement that is calculated to achieve the same purpose may be substituted for the specific embodiment shown. This application is intended to cover any adaptations or variations of embodiments of the present invention. It is to be understood that the above description is intended to be illustrative and not restrictive. Combinations of the above embodiments, and other embodiments, will be apparent to those of skill in the art upon studying the above description.

What is claimed is:

1. An interconnection system, comprising:

a female portion and a male portion;

a plurality of first communication contacts located within the female portion;

a plurality of corresponding second communication contacts located on the male portion, to interface with the first communication contacts;

a guide on one of the portions, separate from the communication contacts, to engage with a guide hole on the other portion, the guide including:

a leading taper section;

a tolerance fit section; and wherein the tolerance fit section is configured to engage with the guide hole before the first communication contacts interface with the second communication contacts, and wherein the guide further includes a power contact surface and a ground contact surface.

2. The interconnection system of claim 1, wherein the first and second communication contacts include electrical communication contacts.

3. The interconnection system of claim 1, wherein the first and second communication contacts include optical communication contacts.

4. The interconnection system of claim 1, wherein at least a portion of the first and second communication contacts are configured in a USB standard configuration.

5. The interconnection system of claim 4, wherein at least a portion of the first and second communication contacts are configured in a mini USB standard configuration.

6. The interconnection system of claim 4, wherein at least a portion of the first and second communication contacts are configured in a micro USB standard configuration.

7. The interconnection system of claim 4, wherein at least a portion of the first and second communication contacts are configured in a USB 2.0 standard configuration.

8. The interconnection system of claim 4, wherein at least a portion of the first and second communication contacts are configured in a USB 3.0 standard configuration.

9. The interconnection system of claim 1, further including a port for transmission of media.

10. The interconnection system of claim 1, further including a heat pipe.

11. The interconnection system of claim 1, wherein the leading taper section is non-conductive.

12. The interconnection system of claim 1, wherein the leading taper section is conductive.

13. The interconnection system of claim 1, wherein the guide is within the female portion, and the guide hole is on the male portion.

14. The interconnection system of claim 1, wherein the power contact surface is configured to engage with the guide hole before the first communication contacts interface with the second communication contacts.

15. The interconnection system of claim 1, wherein the power contact surface is located in a recess below a surface of the tolerance fit section.

16. The interconnection system of claim 1, wherein the ground contact is coupled to the leading taper section such that the ground contact engages with the guide hole before the power contact engages with the guide hole.

17. The interconnection system of claim wherein the power contact is on an opposite surface of the guide from the ground contact.

18. The interconnection system of claim 1, wherein the guide includes two different power contacts, each assigned to operate at different voltages.

19. The interconnection system of claim 18, wherein the guide includes a system peripheral interface (SPI) contact.

20. A portion of an interconnection system, comprising:

a plurality of communication contacts;

a guide hole, separate from the communication contacts, to engage with a corresponding guide in another portion of the interconnection system before the communication contacts interface with communication contacts of the other portion of the interconnection system;

wherein the guide hole includes power contact surfaces having a supply contact and a ground contact.

21. The portion of an interconnection system of claim 20, wherein the power contact surface is configured to engage with the guide before the communication contacts interface with the corresponding communication contacts of the other portion of the interconnection system.

22. The portion of an interconnection system of claim 20, wherein the supply contact is on an opposite surface from the ground contact.

23. The portion of an interconnection system of claim 22, wherein the guide hole includes two different supply contacts, each assigned to operate at different voltages.

24. The portion of an interconnection system of claim 23, wherein the guide hole includes a system peripheral interface (SPI) contact.

25. The portion of an interconnection system of claim 20, wherein the portion of the interconnection system is integrated with a peripheral electronic device.

26. A portion of an interconnection system, comprising:

a plurality of communication contacts;

a guide, separate from the communication contacts, to engage with a guide hole of another portion of the interconnection system, the guide including:

a leading taper section; and a tolerance fit section, wherein the tolerance fit section is configured to engage with the guide hole of the other portion before the communication contacts interface with communication contacts of the other portion, wherein the guide hole includes a power contact and a ground contact surface configured to engage with the guide before the communication contacts interface with the corresponding communication contacts of the other portion of the interconnection system.

27. The portion of the interconnection system of claim 26, wherein the guide is further configured to provide a heat exchange capability between the portion and the other portion.

28. The portion of the interconnection system of claim 26, wherein the guide is further configured to provide a conduit for exchanging materials.

29. The portion of the interconnection system of claim 26, wherein the portion is arranged as a socket of a host device.

* * * * *

UNITED STATES PATENT AND TRADEMARK OFFICE

CERTIFICATE OF CORRECTION

PATENT NO. : 8,632,354 B2
APPLICATION NO. : 13/211103
DATED : January 21, 2014
INVENTOR(S) : Michael George et al.

It is certified that error appears in the above-identified patent and that said Letters Patent is hereby corrected as shown below:

In the Claims

In column 6, line 62, in Claim 17, delete "claim" and insert -- claim 1, --, therefor.

Signed and Sealed this
First Day of April, 2014

Michelle K. Lee

Michelle K. Lee
*Deputy Director of the United States Patent and Trademark Office*